US010711431B2

(12) United States Patent
Zent et al.

(10) Patent No.: US 10,711,431 B2
(45) Date of Patent: Jul. 14, 2020

(54) CLAMP IMPLEMENT FOR EXCAVATOR

(71) Applicant: Clark Equipment Company, West Fargo, ND (US)

(72) Inventors: Kevin J Zent, Bismarck, ND (US); Jonathan J. Roehrl, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/177,819

(22) Filed: Nov. 1, 2018

(65) Prior Publication Data

US 2019/0127947 A1 May 2, 2019

Related U.S. Application Data

(60) Provisional application No. 62/580,172, filed on Nov. 1, 2017.

(51) Int. Cl.

| | |
|---|---|
| ***E02F 3/43*** | (2006.01) |
| ***E02F 9/22*** | (2006.01) |
| ***E02F 3/32*** | (2006.01) |
| ***E02F 3/42*** | (2006.01) |
| ***E02F 3/413*** | (2006.01) |
| ***E02F 9/20*** | (2006.01) |
| ***E02F 3/40*** | (2006.01) |

(52) U.S. Cl.

CPC ..... *E02F 3/437* (2013.01); *E02F 3/32* (2013.01); *E02F 3/404* (2013.01); *E02F 3/4135* (2013.01); *E02F 3/425* (2013.01); *E02F 9/2004* (2013.01); *E02F 9/2221* (2013.01); *E02F 9/2267* (2013.01)

(58) Field of Classification Search

CPC ..... E02F 3/437; E02F 9/2221; E02F 3/404; E02F 9/2004; E02F 3/425; E02F 3/32; E02F 9/2267; E02F 3/4135

See application file for complete search history.

(56) References Cited

U.S. PATENT DOCUMENTS 5,375,348 A * 12/1994 Kishi ..... B66C 13/14 37/186
5,472,308 A * 12/1995 Somero ..... E02F 3/404 37/406
5,553,408 A * 9/1996 Townsend ..... E02F 3/404 37/406
5,813,822 A * 9/1998 Pisco ..... E02F 3/3622 294/104

(Continued)

FOREIGN PATENT DOCUMENTS

AU 717522 B2 3/2000

OTHER PUBLICATIONS

International Search Report and Written Opinion dated Feb. 22, 2019 for International Application No. PCT/US2018/058670 filed Nov. 1, 2018, 13 pages.

*Primary Examiner* — Rodney A Butler
(74) *Attorney, Agent, or Firm* — John D. Veldhuis-Kroeze; Westman, Champlin & Koehler, P.A.

(57) ABSTRACT

A clamp implement and a control system for controlling the clamp implement such that the clamp implement can be caused to follow motion of a bucket or other primary implement in a selected mode of operation. In another mode of operation, the claim implement can be caused to move independently of the primary implement.

16 Claims, 4 Drawing Sheets

(56) References Cited

U.S. PATENT DOCUMENTS

| | | | | |
|---|---|---|---|---|
| 6,135,290 | A * | 10/2000 | Heiple | B07B 1/00 209/235 |
| 6,385,870 | B1 * | 5/2002 | Webel | E02F 9/2004 37/406 |
| 6,742,291 | B2 * | 6/2004 | Frigon | E02F 3/404 37/406 |
| 7,617,619 | B2 * | 11/2009 | Cox | E02F 3/404 37/406 |
| 9,404,236 | B2 * | 8/2016 | Toraason | E02F 3/4135 |
| 2005/0193599 | A1 * | 9/2005 | McCoy | E02F 3/404 37/406 |
| 2006/0150446 | A1 * | 7/2006 | Ottoni | E02F 3/404 37/406 |
| 2008/0011155 | A1 | 1/2008 | Connolly et al. | |
| 2009/0282710 | A1 * | 11/2009 | Johnson | E02F 3/3677 37/406 |
| 2013/0216347 | A1 * | 8/2013 | Breuer | E02F 3/325 414/739 |
| 2016/0312433 | A1 * | 10/2016 | Parker | E02F 3/38 |
| 2017/0002545 | A1 * | 1/2017 | Kaneta | E02F 3/963 |
| 2019/0100896 | A1 * | 4/2019 | Frey | E02F 3/3622 |

* cited by examiner

CLAMP IMPLEMENT FOR EXCAVATOR

CROSS-REFERENCE TO RELATED APPLICATION

This application claims the benefit of U.S. Provisional Application No. 62/580,172, which was filed on Nov. 1, 2017.

BACKGROUND

Some power machines, including excavators, are configured to utilize a primary implement, often in the form of a backhoe bucket available for attachment to a lift arm. Some power machines also provide a secondary implement on the same lift arm as the primary implement, often in the form of a hydraulically powered clamp that is opposable to the primary implement. One example of such a secondary implement is a so-called thumb implement on a lift arm of an excavator. The typical clamp or thumb implement cooperates with the primary implement, for example a bucket, for pinching objects between the primary and secondary implements, and is typically used to pick-up and place objects such as rocks or construction debris.

Controlling a clamp implement and a bucket implement simultaneously can be difficult for an operator of a machine. Objects being moved can be inadvertently crushed or dropped due to the difficulty for an operator during such operations.

The discussion above is merely provided for general background information and is not intended to be used as an aid in determining the scope of the claimed subject matter.

SUMMARY

Disclosed are a clamp implement and a control system for controlling the clamp implement such that the clamp implement can be caused to automatically follow motion of a bucket or other primary implement in a selected mode of operation.

In an exemplary embodiment, a power machine is disclosed including a frame (102); a lift arm structure (110) coupled to the frame, the lift arm structure configured to have a first implement (112) rotatably coupled to the lift arm structure; a tilt actuator (116) coupled to the lift arm structure and configured to control orientation of the first implement relative to the lift arm structure; a second actuator (210) coupled to the lift arm structure and configured to control orientation of a second implement (220) relative to the lift arm structure and relative to the first implement; a tilt position input device (310) configured to be manipulated by an operator and to responsively provide tilt control signals indicative of an operator's intention to control the orientation of the first implement relative to the lift arm structure; a mode control input device (305) configured to be manipulated by an operator to provide a mode selection input in order to select a mode of operation for controlling the tilt actuator and the second actuator responsive to actuation of the tilt position input device; and a controller a controller (315) coupled to the tilt position input device and the mode control input device. The controller is configured to determine a selected mode of operation based upon the mode selection input. The controller is further configured such that when the selected mode of operation is a first mode of operation only the tilt actuator is controlled responsive to the tilt control signals from the tilt position input device such that the first implement moves independently of the second implement, and such that when the selected mode of operation is a second mode of operation both of the tilt actuator and the second actuator are controlled responsive to the tilt control signals from the tilt position input device such that the second implement automatically follows motion of the first implement.

In some exemplary embodiments, the first implement (112) is a bucket and the second implement (220) is a clamp implement. Further, in some embodiments, the power machine further comprises a first implement carrier (162) pivotally coupled to the lift arm structure and configured to rotatably couple the first implement (112) to the lift arm structure, and a second implement carrier (202) pivotally coupled to the lift arm structure and configured to rotatably couple the second implement (220) to the lift arm structure.

In some exemplary embodiments, the power machine further comprises at least one hydraulic pump (322); and a control valve (320) fluidically coupled to the at least one hydraulic pump, to the tilt actuator (116) and to the second actuator (210). The control valve receives valve control signals from the controller to control provision of pressurized hydraulic fluid from the at least one hydraulic pump to the tilt actuator and to the second actuator.

In some exemplary embodiments, the power machine includes a clamp control input device configured to be manipulated by the operator and to responsively provide clamp control signals to the controller indicative of the operator's intention to control the orientation of the clamp relative to the lift arm structure or relative to the first implement. The controller is configured, in such embodiments, so that in the first mode of operation the second or clamp actuator is controlled responsive to the clamp control signals from the clamp control input device.

In some exemplary embodiments, the controller is configured such that in the second mode of operation, clamp control signals from the clamp control input device cause the controller to override coordinated movement between the first and second implement such that the tilt actuator is controlled responsive to the tilt control signals from the tilt position input device and such that the clamp implement is controlled responsive to the clamp control signals from the clamp control input device.

In another exemplary embodiment, a method (400) is provided of controlling a tilt actuator (116) coupled to a first implement (112) to control orientation of the first implement relative to a lift arm structure (110) of a power machine and of controlling a second actuator (210) coupled to a second implement (220) to control orientation of the second implement relative to the lift arm structure and relative to the first implement. The method includes receiving (402) a mode selection input from a mode selection input device (305); determining (404, 408), using a controller (315), a selected mode of operation, from at least two modes of operation, based upon the mode selection input; receiving (406) tilt control signals from a tilt position input device (310) indicative of an operator's intention to control the orientation of the first implement relative to the lift arm structure. The method also includes controlling (410), using the controller when the selected mode of operation is a first mode of operation, only the tilt actuator responsive to the tilt control signals from the tilt position input device such that the first implement moves independently of the second implement; and controlling (412), using the controller when the selected mode of operation is a second mode of operation, both of the tilt actuator and the second actuator responsive to the tilt control signals from the tilt position input device such that the second implement automatically follows motion of the first implement.

In some embodiments, the first implement of the method is a bucket, and the second implement is a clamp implement. The method can further comprise receiving clamp control signals from a clamp control input device manipulated by the operator. Controlling (410) only the tilt actuator responsive to the tilt control signals, using the controller when the selected mode of operation is the first mode of operation, can further comprises controlling the second actuator responsive to the clamp control signals to independently control an orientation of the clamp implement relative to the bucket.

Controlling (412) both of the tilt actuator and the second actuator responsive to the tilt control signals from the tilt position input device, using the controller when the selected mode of operation is the second mode of operation, can further comprise, upon receipt of the clamp control signals from the clamp control input device, overriding coordinated movement between the first and second implement such that the tilt actuator is controlled responsive to the tilt control signals from the tilt position input device and such that the second actuator is controlled responsive to the clamp control signals from the clamp control input device.

In another exemplary embodiment, and excavator is disclosed comprising a frame (102); a lift arm structure (110) coupled to the frame; a bucket (112) rotatably coupled to the lift arm structure; a clamp implement (220) rotatably coupled to the lift arm structure; a tilt actuator (116) coupled to the lift arm structure and the bucket and configured to control orientation of the bucket relative to the lift arm structure; a clamp actuator (210) coupled to the lift arm structure and to the clamp implement and configured to control orientation of the clamp implement relative to the lift arm structure and relative to the bucket; a tilt position input device (310) configured to be manipulated by an operator and to responsively provide tilt control signals indicative of the operator's intention to control the orientation of the bucket relative to the lift arm structure; a clamp control input device configured to be manipulated by the operator and to responsively provide clamp control signals to the controller indicative of the operator's intention to control the orientation of the clamp implement relative to the lift arm structure or relative to the bucket; a mode control input device (305) configured to be manipulated by the operator to provide a mode selection input in order to select a mode of operation for controlling the tilt actuator and the clamp actuator; and a controller (315) coupled to the tilt position input device, the clamp control input device, and the mode control input device. The controller is configured to determine a selected mode of operation based upon the mode selection input. The controller is also configured such that when the selected mode of operation is a first mode of operation only the tilt actuator is controlled responsive to the tilt control signals from the tilt position input device such that the bucket moves independently of the clamp implement, and such that when the selected mode of operation is a second mode of operation both of the tilt actuator and the clamp actuator are controlled responsive to the tilt control signals from the tilt position input device such that the clamp implement automatically follows motion of the first implement.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Before any embodiments are explained in detail, it is to be understood that the concepts discussed in the embodiments set forth herein are not limited in their application to the details of construction and the arrangement of components set forth in the following description or illustrated in the following drawings. The terminology used herein is for the purpose of description and should not be regarded as limiting. The use of "including," "comprising," or "having" and variations thereof herein is meant to encompass the items listed thereafter and equivalents thereof as well as additional items.

Figure 1:
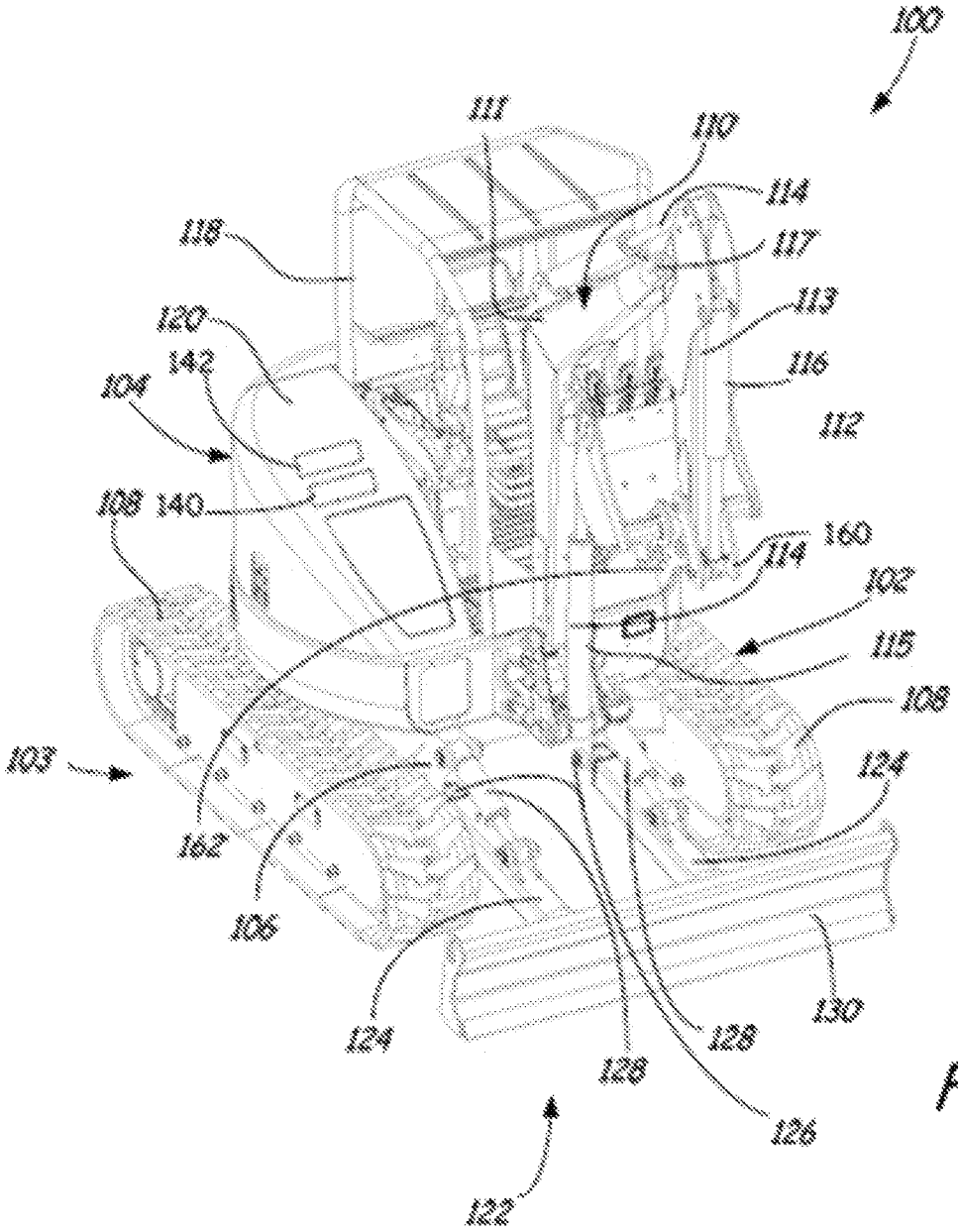
FIG. 1 is a perspective view of a representative power machine on which disclosed embodiments can be practiced.

FIG. 1 illustrates a perspective view of a representative power machine 100 that can employ the disclosed embodiments. The power machine 100 illustrated in FIG. 1 is a self-propelled power excavator, but other types of power machines such as skid-steer loaders, tracked loaders, steerable wheeled loaders, including all-wheel steer loaders, telehandlers, walk-behind loaders and utility vehicles, to name but a few examples of power machines with lift arms that are configured to carry implements that may employ the disclosed embodiments. Furthermore, implements that are attachable to a power machine may also employ the disclosed embodiments. Power machine 100 has a frame 102 including a chassis or undercarriage 103 and an upper frame 104 that is rotatably mounted on the undercarriage. Undercarriage 103 includes a lower frame 106 and a pair of support surface engaging track assemblies 108 that are attached to the lower frame 106 and driven with a suitable drive arrangement, such as one or more with hydraulic drive motors.

Upper rotatable frame 104 supports a pivotally mounted two-section lift arm structure 110 that includes both a boom section 111 and an arm section 113, configured to have an implement 112 (a backhoe-style bucket is shown in FIG. 1) attached to an outer end thereof. For the purposes of this discussion, a lift arm structure refers to a pivotable structure attached to a frame and configured for movement relative to the frame for the purposes of positioning an attached tool or implement. In the case of power machine 100, a specific type of lift arm is disclosed, namely, a two-section boom and arm configuration in which each section is moveable. Other power machines such as loaders, to name one example, can have different lift arm structures that fit within the scope of the phrase lift arm structure as used here. The boom section 111 and arm section 113 of lift arm structure 110 are illustratively selectively powered by actuators shown generally at 114 for moving the respective sections 111, 113 about horizontal pivots 115, 117. An implement carrier 162 is pivotally coupled to the lift arm structure 110 and is configured to accept and secure an implement such as implement 112 to the lift arm structure 110. Implement carrier 162 is also selectively powered by an actuator 116, typically referred to as a tilt actuator, to allow for pivotable movement with respect to the lift arm structure 110. The term implement carrier refers generally to a structure configured to accept and secure an implement to a power machine and more particularly a lift arm structure. An implement attached to an implement carrier should be distinguished from an implement that is attached directly to a lift arm such as by being pinned to the end of a lift arm. Implements can be pinned or otherwise attached to an implement carrier, and the implement carrier is attached to the lift arm structure. In most instances, the implement carrier is pivotally attached to the lift arm. Upper rotatable frame 104 also includes an operator compartment 118 and a housing 120 for an engine for providing power to the suitable drive arrangement that drives the pair of ground engaging track assemblies 108. A plurality of actuable input devices (not shown in FIG. 1) are positioned within the operator compartment 118 to allow an operator to control functions of the machine including, for example, the drive function, manipulation of the lift arm structure 110, and the implement carrier 162.

The power machine 100 illustrated in FIG. 1 also includes a second lift arm structure 122 that is operably coupled to the lower frame 106. The second lift arm structure 122 illustratively includes a pair of lift arms 124 that are rotatably coupled to the lower frame 106 at pivot points 126. A pair of actuators 128 are also coupled to the lower frame 106 and lift arms 124. A blade implement 130 is an illustrative example of an implement that can be coupled to the lift arm structure 122. Other implements can be attached to the lift arm structure 122, including implements such as a pivoting blade that can be pivoted or angled with respect to the lift arm structure 122. Alternatively still, an implement carrier can be attached to the lift arm structure 122 to accept various implements. An example of such an implement carrier is illustrated in U.S. Pat. No. 8,024,875 of Wetzel et al., incorporated herein by reference. The actuators 128 are configured to rotate the lift arm structure 122 with respect to the lower frame 106 to raise and lower the blade implement 130. While FIG. 1 shows two actuators 128, alternatively, a single actuator may be employed to control the angular position of the lift arm structure 124 with respect to the lower frame 106.

Power machine 100 includes a power source 140 in the form of an internal combustion engine. Other power machine can incorporate other power sources including electrical power systems or a hybrid power system such as one that includes an electrical power source and an internal combustion engine. The power source 140 is operably coupled to a power conversion system 142 that receives power from the power source 140 and control signals from operator input devices to convert the received power to operational signals that operate functional components of the power machine. The power conversion system 142 of representative power machine 100 includes hydraulic components including a plurality of hydraulic pumps (not shown) that are configured to provide pressurized hydraulic fluid to valve components (not shown) that control the flow of hydraulic fluid to various actuators used to control functional components of the power machine 100. Other power machines can include various combinations of pumps, valve components, and actuators, including machines with hydrostatic drive systems. Still other power machines can include other, non-hydraulic components to convert power from a power source including gear reductions, clutches, drive trains, power takeoffs, and electric generators, to name a few.

Among the functional components that receive signals from the power conversion system 142 are tractive elements 108, illustratively shown as track assemblies, which are configured to rotatably engage a support surface to cause the power machine to travel. In other embodiments, such as certain loader embodiments employing a backhoe implement or other excavators, the tractive elements can be wheels. In an example embodiment, a pair of hydraulic motors (not shown in FIG. 1), are provided to convert a hydraulic power signal into a rotational output for left and right sides of the machine. In other embodiments, differing numbers of hydraulic motors can be employed. Other functional components include the lift arm structure 122.

Figure 2:
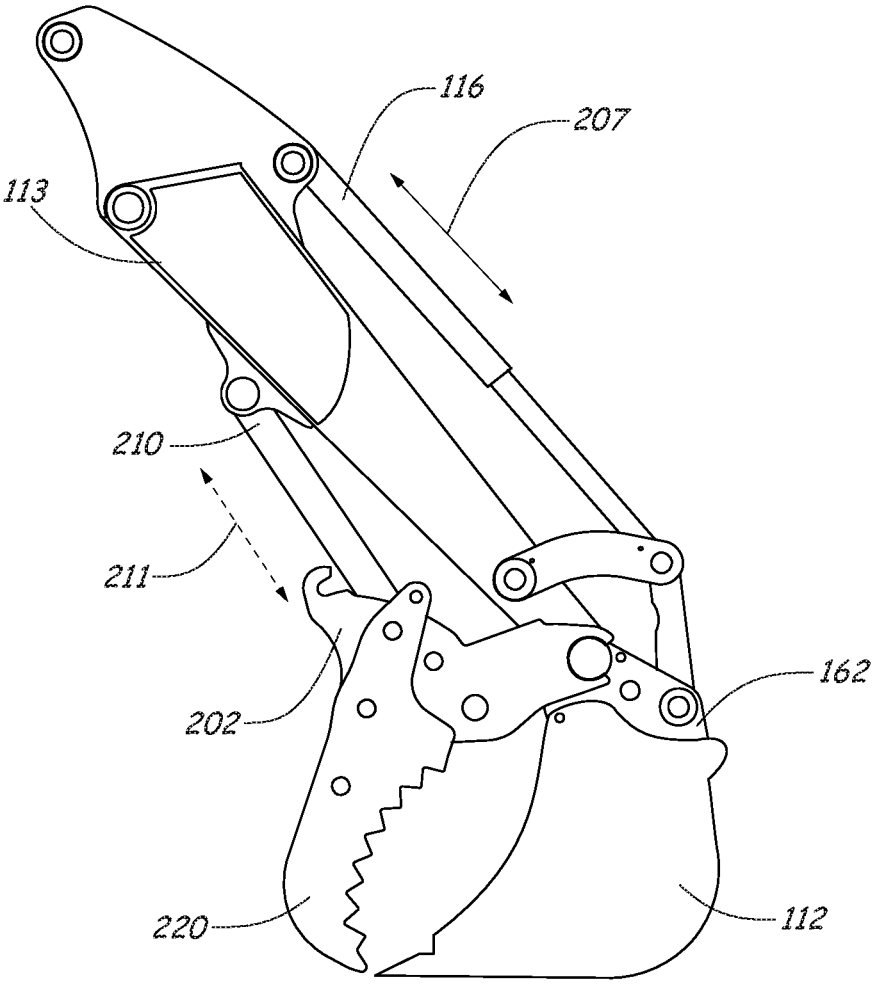
FIG. 2 is an illustration of a clamp implement coupled to a lift arm similar to that of the representative power machine of FIG. 1 according to one illustrative embodiment.

Referring now to FIG. 2, shown in greater detail is one embodiment of an arm section 113 of lift arm for an power machine of the type described above and illustrated in FIG. 1. Arm section 113 has a primary implement 112, such as a bucket, pivotally mounted thereto via implement carrier 162. Tilt actuator 116, typically in the form of a hydraulic tilt cylinder, is coupled between arm section 113 and implement carrier 162 to control orientation of primary implement 112 relative to the arm section. Tilt actuator 116 extends and retracts in the direction of arrow 207 in order to rotate implement carrier 162 and/or implement 112 relative to arm section 113. In other embodiments, a bucket can be pinned directly to an arm section of the lift arm instead of being attached to an implement carrier.

A second implement 220, referred to as a clamp implement, is also pivotally mounted to arm section 113 via a second implement carrier 202 (or alternatively, via a direct coupling to the arm section). A clamp actuator 210, also typically in the form of a hydraulic cylinder, is coupled between arm section 113 and clamp implement 220 to control orientation of the clamp implement relative to the arm section and/or relative to primary implement 112. Clamp actuator 210 extends and retracts generally in the direction of arrow 211 to rotate implement carrier 202 and/or clamp implement 220 relative to arm section 113 and, when desired, relative to primary implement 112.

In some embodiments, to increase ease of use for an operator of the power machine during a material handling operation, clamp actuator 210 is controllable such that clamp implement 220 follows the motion of the primary implement 112 (e.g., a bucket). Following the motion of the primary implement means that the clamp implement 220 maintains a constant angular orientation with respect to the primary implement as the primary implement is rotated. In some embodiments, the clamp implement 220 can increase the pressure on an item held between the clamp implement and the primary implement 112 as the primary implement moves in one or both directions. In other embodiments, this need not be the case. By automatically following the primary implement, clamp implement 220 can be operated in a mode which is useful in retaining objects. With force from clamp actuator 210 automatically maintained during operator control of tilt actuator 116 and primary implement 112, for example by retaining pressure within a clamp actuator hydraulic cylinder, objects are more easily secured. This increases ease of use during material handling. In some embodiments, automatic control of the clamp implement 220 prevents crushing or dropping of objects, and allows for easier placement of the objects being carried. In some embodiments, clamp actuator 210 and clamp 220 are configured to provide a range of motion which allows movement along the full range of motion of the bucket or primary implement 112, although this need not be the case in all embodiments.

Figure 3:
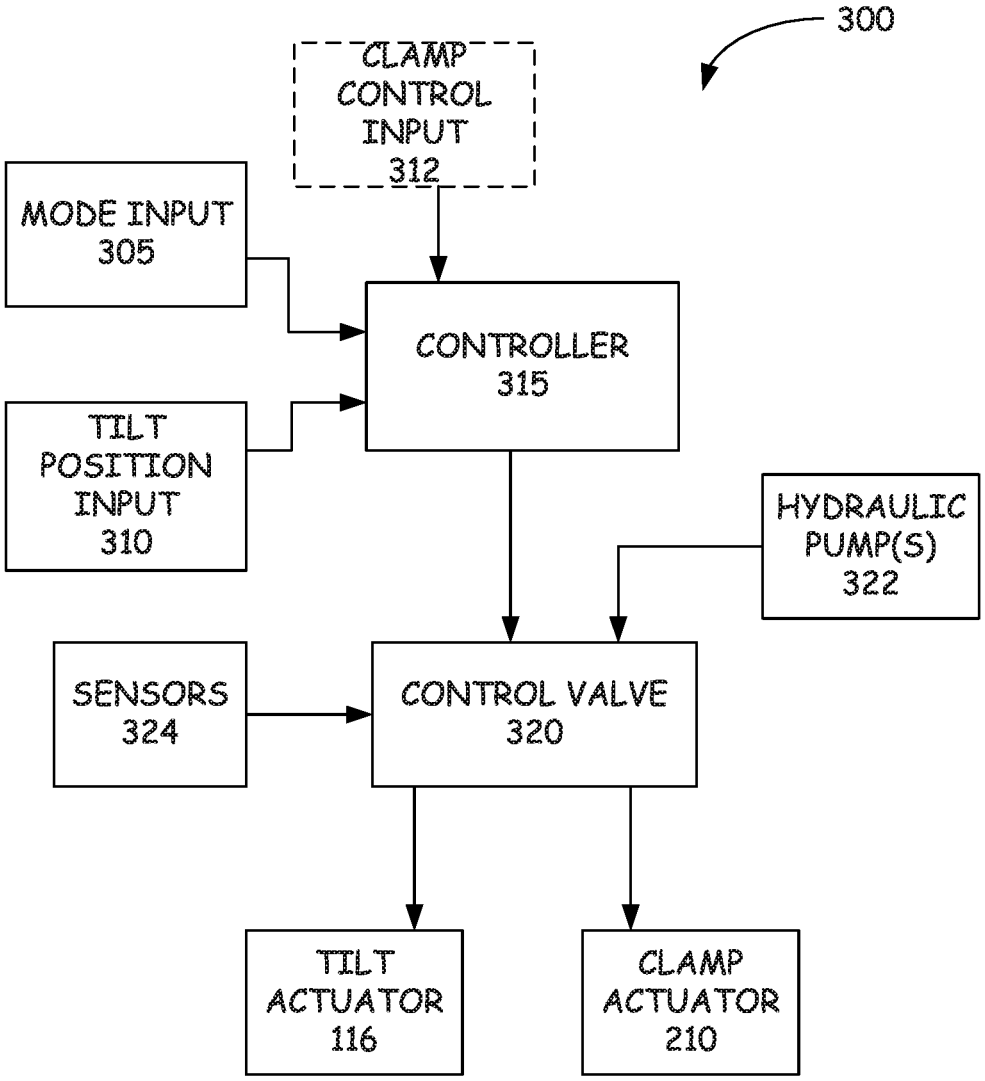
FIG. 3 is an illustration of a system for controlling operation of the clamp implement in accordance with exemplary embodiments.

Referring now to FIG. 3, shown is a system 300 of power machine 100 in accordance with some exemplary embodiments. System 300 includes mode selection input 305 and a tilt position operator control input 310, which can be implemented using operator control devices such as those in operator compartment 118 discussed above. A controller 315 receives input signals or data from inputs 305 and 310 and responsively controls a control valve 320 to control the coupling of pressurized hydraulic fluid, from one or more hydraulic pumps 322 of the above-discussed power conversion system 142, to tilt actuator 116 and clamp actuator 210.

In some embodiments, an optional clamp control input 312 is provided to allow the operator to control the clamp actuator, and thus clamp implement 220, separately from tilt actuator 116 and primary implement 112, but this need not be the case in all embodiments. In such embodiments, controller 315 responsively controls different valves within control valve 320 to separately control tilt actuator 116 responsive to tilt position input 310 and clamp actuator 210 responsive to clamp control input 312.

Controller 315 is configured such that, upon selection of a clamp following mode of operation using mode input 305, controller 315 provides signals to control valve 320 to control movement of both of tilt actuator 116 and clamp actuator 210 responsive to tilt position input 310, such that clamp implement 220 automatically follows motion of primary implement 112 in order to retain objects, thereby increasing ease of use for the operator during material handling operations. This prevents objects from being crushed or dropped due to operator inability to coordinated movement of both primary implement 112 and clamp implement 220, and allows for easier placement of objects. Movement is coordinated, in some embodiments, by sensors 324 that are configured to measure rotational positions of the primary implement 112 and the second implement 220 or actuation positions of the tilt actuator 116 and the clamp actuator 210 and maintaining a consistent relationship between them as the primary implement is being moved via actuation of the tilt actuator. In some embodiments, inputs from the clamp control input 312 can override the coordinated movement of the two implements. This can allow an operator to use the clamp control input to temporarily override coordination such as when an operator may want to release an object that is being held by the clamp implement.

Figure 4:
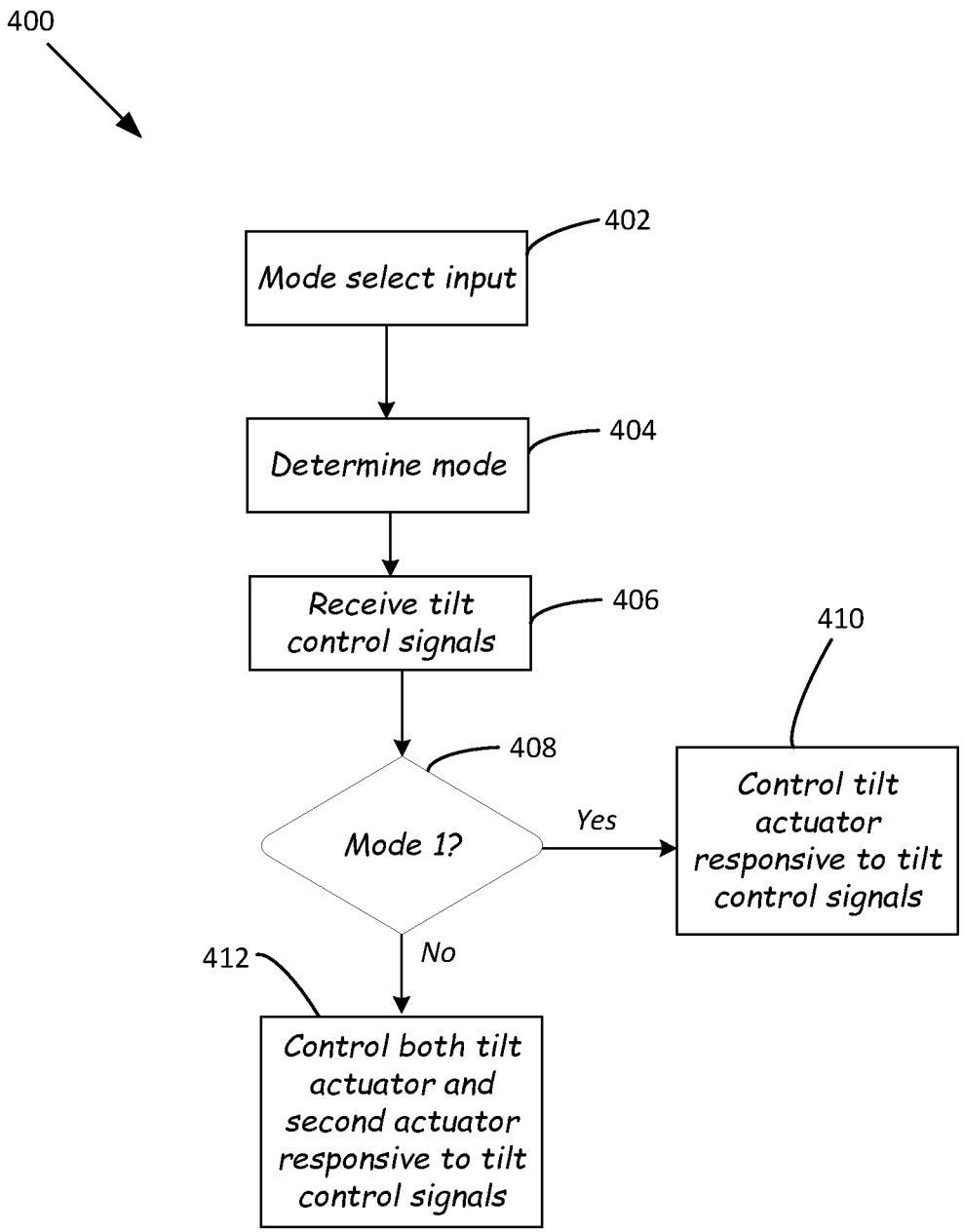
FIG. 4 is a flow diagram illustrating a method of controlling a bucket and a clamp implement in accordance with an exemplary embodiment.

Referring now to FIG. 4, shown is a flow diagram illustrating an exemplary method 400 of controlling tilt actuator 116 to control orientation of the bucket 112 relative to lift arm structure 110 and of controlling clamp actuator 210 to control orientation of the clamp or second implement 220 relative to the lift arm structure and relative to the bucket. As shown at block 402, the method includes receiving a mode selection input from mode selection input device 305. At block 404, a determination is made by controller 315 as to which of at least two modes of operation are selected based upon the mode selection input. As discussed, the modes include a first mode in which the tilt position input device 310 controls only the orientation of the bucket, and a second mode where the tilt position input device controls both the orientation of the bucket and the orientation of the clamp implement.

At block 406 tilt control signals are received from the tilt position input device 310 to indicate the operator's intention to control the orientation of the bucket or first implement relative to the lift arm structure. Then, at 408, a decision is made as to whether the selected mode is the first mode, or alternatively the second mode. If it is determined that the first mode is selected, then the controller controls only the tilt actuator responsive to the tilt control signals from the tilt position input device, causing the bucket or first implement to move independently of the clamp or second implement. If, however, it is determined that the first mode is not selected (or that the second mode is selected), then the controller controls both of the tilt actuator and the clamp or second actuator responsive to the tilt control signals such that the second implement automatically follows motion of the first implement.

As discussed, in the first mode of operation, when clamp control signals are received from the clamp control input device, the controller controls the clamp actuator responsive to the clamp control signals to independently control orientation of the clamp implement relative to the bucket. In the second mode of operation in which both of the tilt actuator and the clamp actuator are controlled responsive to the tilt control signals from the tilt position input device, if clamp control signals are received from the clamp control input device, the controller overrides coordinated movement between the bucket and the clamp, and the tilt actuator is controlled responsive to the tilt control signals while the clamp actuator is controlled responsive to the clamp control signals from the clamp control input device.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. For example, in various embodiments, different types of power machines can be configured to employ the disclosed clamp implement assembly, control systems and methods. Other examples of modifications of the disclosed concepts are also possible, without departing from the scope of the disclosed concepts.

What is claimed is:

1. A power machine comprising:

a frame;

a lift arm structure coupled to the frame, the lift arm structure configured to have a first implement rotatably coupled to the lift arm structure;

a tilt actuator coupled to the lift arm structure and configured to control orientation of the first implement relative to the lift arm structure;

a second actuator coupled to the lift arm structure and configured to control orientation of a second implement relative to the lift arm structure and relative to the first implement;

a tilt position input device configured to be manipulated by an operator and to responsively provide tilt control signals indicative of an operator's intention to control the orientation of the first implement relative to the lift arm structure;

a mode control input device configured to be manipulated by an operator to provide a mode selection input to select a mode of operation for controlling the tilt actuator and the second actuator responsive to actuation of the tilt position input device;

a controller coupled to the tilt position input device and the mode control input device, wherein the controller is configured to determine a selected mode of operation based upon signals received from the mode selection input, the controller configured such that when the selected mode of operation is a first mode of operation only the tilt actuator is controlled responsive to the tilt control signals from the tilt position input device such that the first implement moves independently of the second implement, and such that when the selected mode of operation is a second mode of operation both the tilt actuator and the second actuator are controlled responsive to the tilt control signals from the tilt position input device such that the second implement follows motion of the first implement.

2. The power machine of claim 1, wherein the first implement is a bucket and the second implement is a clamp implement.

3. The power machine of claim 2, and further comprising a first implement carrier pivotally coupled to the lift arm structure and configured to rotatably couple the first implement to the lift arm structure, and a second implement carrier pivotally coupled to the lift arm structure and configured to rotatably couple the second implement to the lift arm structure.

4. The power machine of claim 2, and further comprising:

at least one hydraulic pump; and a control valve fluidically coupled to the at least one hydraulic pump, to the tilt actuator and to the second actuator, the control valve receiving valve control signals from the controller to control provision of pressurized hydraulic fluid from the at least one hydraulic pump to the tilt actuator and to the second actuator.

5. The power machine of claim 4, and further comprising a clamp control input device configured to be manipulated by the operator and to responsively provide clamp control signals to the controller indicative of the operator's intention to control the orientation of the clamp relative to the lift arm structure or relative to the first implement.

6. The power machine of claim 5, wherein the controller is configured such that in the first mode of operation the second actuator is controlled responsive to the clamp control signals from the clamp control input device.

7. The power machine of claim 6, wherein the controller is configured such that in the second mode of operation clamp control signals from the clamp control input device cause the controller to override coordinated movement between the first and second implement such that the tilt actuator is controlled responsive to the tilt control signals from the tilt position input device and such that the clamp implement is controlled responsive to the clamp control signals from the clamp control input device.

8. A method of controlling a tilt actuator coupled to a first implement to control orientation of the first implement relative to a lift arm structure of a power machine and of controlling a second actuator coupled to a second implement to control orientation of the second implement relative to the lift arm structure and relative to the first implement, the method comprising:

receiving a mode selection input from a mode selection input device;

determining, using a controller, a selected mode of operation, from at least two modes of operation, based upon the mode selection input;

receiving tilt control signals from a tilt position input device indicative of an operator's intention to control the orientation of the first implement relative to the lift arm structure;

controlling, using the controller when the selected mode of operation is a first mode of operation, only the tilt actuator responsive to the tilt control signals from the tilt position input device such that the first implement moves independently of the second implement; and controlling, using the controller when the selected mode of operation is a second mode of operation, both of the tilt actuator and the second actuator responsive to the tilt control signals from the tilt position input device such that the second implement follows motion of the first implement;

receiving second implement control signals from a second implement control input device manipulated by the operator, and wherein controlling, using the controller when the selected mode of operation is the first mode of operation, only the tilt actuator responsive to the tilt control signals further comprises controlling the second actuator responsive to the second implement control signals to independently control an orientation of the second implement relative to the first implement.

9. The method of claim 8, wherein the first implement is a bucket and the second implement is a clamp implement.

10. The method of claim 8, wherein controlling, using the controller when the selected mode of operation is the second mode of operation, both of the tilt actuator and the second actuator responsive to the tilt control signals from the tilt position input device further comprises, upon receipt of the second implement control signals from the second implement control input device, overriding coordinated movement between the first and second implement such that the tilt actuator is controlled responsive to the tilt control signals from the tilt position input device and such that the second actuator is controlled responsive to the second implement control signals from the second implement control input device.

11. An excavator, comprising:

a frame;

a lift arm structure coupled to the frame;

a bucket rotatably coupled to the lift arm structure;

a clamp implement rotatably coupled to the lift arm structure;

a tilt actuator coupled to the lift arm structure and the bucket and configured to control orientation of the bucket relative to the lift arm structure;

a clamp actuator coupled to the lift arm structure and to the clamp implement and configured to control orientation of the clamp implement relative to the lift arm structure and relative to the bucket;

a tilt position input device configured to be manipulated by an operator and to responsively provide tilt control signals indicative of the operator's intention to control the orientation of the bucket relative to the lift arm structure;

a clamp control input device configured to be manipulated by the operator and to responsively provide clamp control signals to the controller indicative of the operator's intention to control the orientation of the clamp implement relative to the lift arm structure or relative to the bucket;

a mode control input device configured to be manipulated by the operator to provide a mode selection input in order to select a mode of operation for controlling the tilt actuator and the clamp actuator; and a controller coupled to the tilt position input device, the clamp control input device, and the mode control input device, wherein the controller is configured to determine a selected mode of operation based upon the mode selection input, the controller configured such that when the selected mode of operation is a first mode of operation only the tilt actuator is controlled responsive to the tilt control signals from the tilt position input device such that the bucket moves independently of the clamp implement, and such that when the selected mode of operation is a second mode of operation both of the tilt actuator and the clamp actuator are controlled responsive to the tilt control signals from the tilt position input device such that the clamp implement follows motion of the first implement.

12. The excavator of claim 11, and further comprising a first implement carrier pivotally coupled to the lift arm structure and configured to rotatably couple the bucket to the lift arm structure, and a second implement carrier pivotally coupled to the lift arm structure and configured to rotatably couple the clamp implement to the lift arm structure.

13. The excavator of claim 12, and further comprising:

at least one hydraulic pump; and a control valve fluidically coupled to the at least one hydraulic pump, to the tilt actuator and to the clamp actuator, the control valve receiving valve control signals from the controller to control provision of pressurized hydraulic fluid from the at least one hydraulic pump to the tilt actuator and to the clamp actuator.

14. The excavator of claim 13, wherein the controller is configured such that in the first mode of operation the clamp actuator is controlled responsive to the clamp control signals from the clamp control input device.

15. The excavator of claim 14, wherein the controller is configured such that in the second mode of operation clamp control signals from the clamp control input device cause the controller to override coordinated movement between the bucket and the clamp implement such that the tilt actuator is controlled responsive to the tilt control signals from the tilt position input device and such that the clamp actuator is controlled responsive to the clamp control signals from the clamp control input device.

16. A power machine comprising:

a frame;

a lift arm structure coupled to the frame, the lift arm structure configured to have a bucket rotatably coupled to the lift arm structure;

a tilt actuator coupled to the lift arm structure and configured to control orientation of the bucket relative to the lift arm structure;

a second actuator coupled to the lift arm structure and configured to control orientation of a clamp relative to the lift arm structure and relative to the bucket;

a tilt position input device configured to be manipulated by an operator and to responsively provide tilt control signals indicative of an operator's intention to control the orientation of the bucket relative to the lift arm structure;

a clamp control input device configured to be manipulated by the operator and to responsively provide clamp control signals to the controller indicative of the operator's intention to control the orientation of the clamp relative to the lift arm structure or relative to the bucket;

a mode control input device configured to be manipulated by an operator to provide a mode selection input to select a mode of operation for controlling the tilt actuator and the second actuator responsive to actuation of the tilt position input device;

a controller coupled to the tilt position input device, the clamp control input device and the mode control input device, wherein the controller is configured to determine a selected mode of operation based upon signals received from the mode selection input, the controller configured such that when the selected mode of operation is a first mode of operation only the tilt actuator is controlled responsive to the tilt control signals from the tilt position input device such that the first implement moves independently of the second implement and such that the second actuator is controlled responsive to the clamp control signals from the clamp control input device, and the controller further configured such that when the selected mode of operation is a second mode of operation both the tilt actuator and the second actuator are controlled responsive to the tilt control signals from the tilt position input device such that the clamp follows motion of the bucket, wherein the controller is further configured such that in the second mode of operation clamp control signals from the clamp control input device cause the controller to override coordinated movement between the bucket and the clamp such that the tilt actuator is controlled responsive to the tilt control signals from the tilt position input device and such that the clamp is controlled responsive to the clamp control signals from the clamp control input device.

* * * * *